US008848957B2

(12) United States Patent
Karlsen

(10) Patent No.: US 8,848,957 B2
(45) Date of Patent: Sep. 30, 2014

(54) HEARING AID RETAINER ACCESSORY

(71) Applicant: Oticon A/S, Smørum (DK)

(72) Inventor: Morten Friis Karlsen, Smørum (DK)

(73) Assignee: Oticon A/S, Smorum (DK)

( * ) Notice: Subject to any disclaimer, the term of this patent is extended or adjusted under 35 U.S.C. 154(b) by 4 days.

(21) Appl. No.: 13/659,467

(22) Filed: Oct. 24, 2012

(65) Prior Publication Data

US 2013/0121519 A1 May 16, 2013

Related U.S. Application Data

(60) Provisional application No. 61/550,927, filed on Oct. 25, 2011.

(30) Foreign Application Priority Data

Oct. 25, 2011 (EP) ..... 11186427

(51) Int. Cl.
*H04R 25/00* (2006.01)
*H04R 25/02* (2006.01)
*H04R 1/10* (2006.01)

(52) U.S. Cl.
CPC ..... *H04R 25/02* (2013.01); *H04R 1/105* (2013.01); *H04R 1/1008* (2013.01); *H04R 1/10* (2013.01); *H04R 25/60* (2013.01); *H04R 25/602* (2013.01); *H04R 25/65* (2013.01); *H04R 2225/021* (2013.01); *H04R 2225/63* (2013.01)
USPC ..... 381/330; 381/381; 381/374; 381/430

(58) Field of Classification Search
CPC ... H04R 1/105; H04R 1/1066; H04R 2225/63
USPC ..... 381/322, 330, 374, 381, 430
See application file for complete search history.

(56) References Cited

U.S. PATENT DOCUMENTS

| | | | | |
|---|---|---|---|---|
| 3,327,807 | A | 6/1967 | Mullin | |
| 4,529,058 | A * | 7/1985 | Emery | 181/129 |
| 4,702,345 | A * | 10/1987 | Janssen et al. | 181/129 |
| 4,881,616 | A * | 11/1989 | Janssen et al. | 181/129 |
| 4,918,757 | A | 4/1990 | Janssen et al. | |
| 7,013,018 | B2 | 3/2006 | Bøgeskov-Jensen | |

(Continued)

FOREIGN PATENT DOCUMENTS

| | | | |
|---|---|---|---|
| DE | 100 48 337 | C1 | 3/2002 |
| WO | WO 2004/112431 | A1 | 12/2004 |

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

A hearing aid retainer accessory to be used together with a hearing aid is provided having a housing with a relatively large diameter longitudinal end face portion and a relatively smaller diameter hook-end to which a hook is attached. The hearing aid retainer accessory comprises an elongated string with a first end portion and a second portion, a first attaching means connected to the first end portion and a second attaching means connected to the second portion, wherein the first attaching means is attachable to a hook of a hearing aid, the second attaching means is attachable to a longitudinal end face portion of a housing of a hearing aid, such that a retaining ring is formed of both the geometry of a hearing aid and the elongated string.

14 Claims, 5 Drawing Sheets

(56) References Cited

U.S. PATENT DOCUMENTS

| | | | | |
|---|---|---|---|---|
| 7,983,439 | B2 * | 7/2011 | Bruckhoff et al. | 381/381 |
| 8,073,180 | B2 * | 12/2011 | Bruckhoff | 381/381 |
| 8,331,593 | B2 * | 12/2012 | Slemming et al. | 381/318 |
| 8,442,252 | B2 * | 5/2013 | Meosky et al. | 381/324 |
| 8,605,927 | B2 * | 12/2013 | Fretz et al. | 381/328 |
| 2004/0165743 | A1 | 8/2004 | Bayer | |
| 2006/0023909 | A1 | 2/2006 | Grafenberg | |
| 2007/0217641 | A1 | 9/2007 | Rosal | |
| 2007/0264850 | A1 | 11/2007 | Bruckhoff | |
| 2010/0086161 | A1 | 4/2010 | Ilic et al. | |

* cited by examiner

HEARING AID RETAINER ACCESSORY

CROSS REFERENCE TO RELATED APPLICATIONS

This nonprovisional application claims the benefit of U.S. Provisional Application No. 61/550,927 filed Oct. 25, 2011 and claims priority under 35 U.S.C. 119(a) to Patent Application No. 11186427.8 filed in Europe on Oct. 25, 2011, all of which are hereby expressly incorporated by reference into the present application.

BACKGROUND OF THE INVENTION

The invention is related to a hearing aid retainer accessory for retaining a hearing aid, preferably a BTE (behind-the-ear) hearing aid, at a user's ear.

In order to operate at best and to prevent damage resulting from falling of the ear and dropping to the ground, a BTE-hearing has to be kept in a safe position at a user's ear. Even so if the user's head moves intensely as is the case doings sport. Another example is a child playing.

US 2007/0217641 A1 discloses a hearing aid protection accessory formed by a flexible sleeve to be wrapped around a housing of a hearing aid, the flexible sleeve to be connected to a users clothing via a clip and a cord. Suitable for preventing the hearing aid from dropping to the ground this arrangement, however, does not allow an adjustment to a user's ear and is likely to entangle with all kinds of obstacles a child may encounter playing. Also the sleeve adds to the thickness of the hearing aid housing rendering it difficult to be placed behind a small ear.

U.S. Pat. No. 4,881,616 and U.S. Pat. No. 4,702,345 each disclose a hearing aid retainer accessory that is formed by a tube with a respective sleeve connected to each end, both sleeves pulled over the housing of the hearing aid. The arrangement disclosed in U.S. Pat. No. 4,881,616 allows an adjustment to a user ear by moving the sleeves toward or away from each other on the housing of the hearing aid. The degree of adjustment, however, is limited by the longitudinal dimension of the hearing aid housing. The sleeves of both U.S. Pat. No. 4,881,616 and U.S. Pat. No. 4,702,345 add to the thickness of the hearing aid housing, resulting in a discomfort to wear or even the ears protruding, provided they are still in a process of growth. Furthermore, the sleeves are likely to interfere with a control button located at the surface of the hearing aid housing.

U.S. Pat. No. 7,013,018 B2 discloses an adjustable earring for a headset, the earring being connected via a pivotal link to a housing of a speaker included in the headset. However, due to the nature of the headset the speaker is configured to cover the pinna of a user's ear resulting in the speaker and the earring lying askew to each other.

Finally, U.S. Pat. No. 4,918,757 and U.S. Pat. No. 3,327,807 each disclose an arrangement for retaining a hearing aid at a user's head utilizing a head band. Undesirably each of the arrangements exerts an uncomfortable force to the users head and is rather noticeable.

It is therefore an object of the present invention to provide a hearing aid retainer accessory which avoids the disadvantages of prior art devices and is intuitive and easy to attach, comfortable to wear, free of interference with a hearing aid's control buttons and the specially designed hearing aid geometry, all while retaining a hearing aid at a user's ear safely and stably.

SUMMARY OF THE INVENTION

It is an object of the present invention is to provide an alternative hearing aid retainer accessory avoiding the disadvantages of the arrangements known from these prior art devices.

According to a first aspect of the present invention, the technical object is achieved by a hearing aid retainer accessory to be used together with a hearing aid having a housing with a relatively large diameter longitudinal end face portion and a relatively smaller diameter hook-end to which a hook is attached, wherein the hearing aid retainer accessory comprises an elongated string with a first end portion and a second portion, a first attaching means connected to the first end portion and a second attaching means connected to the second portion. The first attaching means is attachable to a hook of a hearing aid, the second attaching means is attachable to a longitudinal end face portion of a housing of a hearing aid, such that a retaining ring is formed of both the geometry of a hearing aid and the elongated string.

The inventive hearing aid retainer accessory is intuitive and easy to attach, comfortable to wear, free of interference with a hearing aid's control buttons and the specially designed hearing aid geometry, all while retaining a hearing aid at a user's ear safely and stably. Neither the first nor the second attaching means add to the circumferential geometry (geometry extending around the longitudinal axis) of the housing of the hearing aid.

The invention includes the realization that prior art hearing aid retainer accessories add to the circumferential geometry of a hearing they are attached to, rendering it uncomfortable or even impossible to wear.

In a preferred embodiment of the present invention, to allow the hearing aid retainer accessory to be adjusted to various ear sizes, the second attaching means comprises a tubular feed-through. The tubular feed-through accommodates the second portion of the elongated string in a friction fitting manner. The hearing aid retainer accessory is adjustable by pulling the elongated string through the tubular feed-through in an according direction.

Alternatively the hearing aid retainer accessory can be adjustable by varying the position at which the first attaching means is attached to a hook of a hearing aid. It is conceivable that the first attaching means comprises a tubular feed-through accommodating the first end portion of the elongated string in a friction fitting manner.

In a further embodiment of the present invention the second portion of the elongated string constitutes a second end portion. This can be achieved by cutting off a part of the second portion that might not be required if—for example—the hearing aid retainer accessory is fitted to a child's ear. Alternatively the second portion of the elongated string can constitute a second end portion without cutting off a part of the second portion, as is the case if the hearing aid retainer accessory is fitted to a large ear.

The second end portion can be secured in the tubular feed-through by a lock pin. If the elongated string is provided as a tube or a solid line with a tubular portion, the lock pin can engage to the inner diameter of the tube or tubular portion, extending its outer diameter. The lock pin can be engaged to the elongated string axially or crossways.

To be even comfortable for a user the first attaching means can be configured as a flexible sleeve. The flexible sleeve can be wrapped around a portion of a hook of a hearing aid. Preferably, the flexible sleeve has a smaller physical dimension than the second attaching means. The first attaching means can be configured as a flexible sleeve having an inner diameter adapted to the outer diameter of a closed surface.

In a further preferred embodiment the second attaching means comprises an end surface portion with a hook-like protrusion. The hook-like protrusion is mechanically engageable to a complementary cut out region in a base portion of a housing of a hearing aid.

The second attaching means can comprise an end surface portion from which the hook-like protrusion extends. The end surface portion can have a surface area of roughly the same size as a longitudinal end face portion of a housing of a hearing aid. In this manner a seamless and harmonic transition between the second attaching means and a hearing aid housing to be connected is achieved.

According to a second aspect of the present invention, the technical object is achieved by a hearing aid and a hearing aid retainer accessory attached thereto. The hearing aid retainer accessory comprises an elongated string with a first end portion and a second portion, a first attaching means connected to the first end portion of the elongated string and a second attaching means connected to the second portion of the elongated string. The hearing aid comprises a hook and housing with a base portion, wherein the first attaching means is attached to the hook, the second attaching means to the base portion. A retaining ring is formed of both the geometry of the hearing aid and the elongated string. Neither the first nor the second attaching means adds to the circumferential geometry of the housing.

In a preferred embodiment the first attaching means is configured as a flexible sleeve having an inner diameter adapted to the outer diameter of the surface hook. The second attaching means can comprise a hook-like protrusion mechanically engaged to the complementary cut out region in the longitudinal end face portion of the housing of the hearing aid. In this manner an especially robust mechanical connection is between the hearing aid and the hearing aid retainer accessory is established.

In a further embodiment the second attaching means comprises an end surface portion from which a hook-like protrusion extends. The end surface portion has surface area of roughly the same size as the longitudinal end face portion of the housing of the hearing aid. This adds to the comfort of the assembly if worn.

To provide an optimal connection between the hearing aid and the hearing aid retainer accessory, the second attaching means can comprise an end surface portion with a hook-like protrusion. The base portion of the hearing aid can comprise a cut out region complementary to the hook-like protrusion of the second attaching means. The hook-like protrusion can be engaged to the respective cut out region mechanically.

In a preferred embodiment, the hearing aid is a BTE-hearing aid.

It is to be understood that the embodiments and advantages described with respect to the first aspect of the present invention apply to the second aspect of the invention and vice versa.

DETAILED DESCRIPTION

Figure 1:
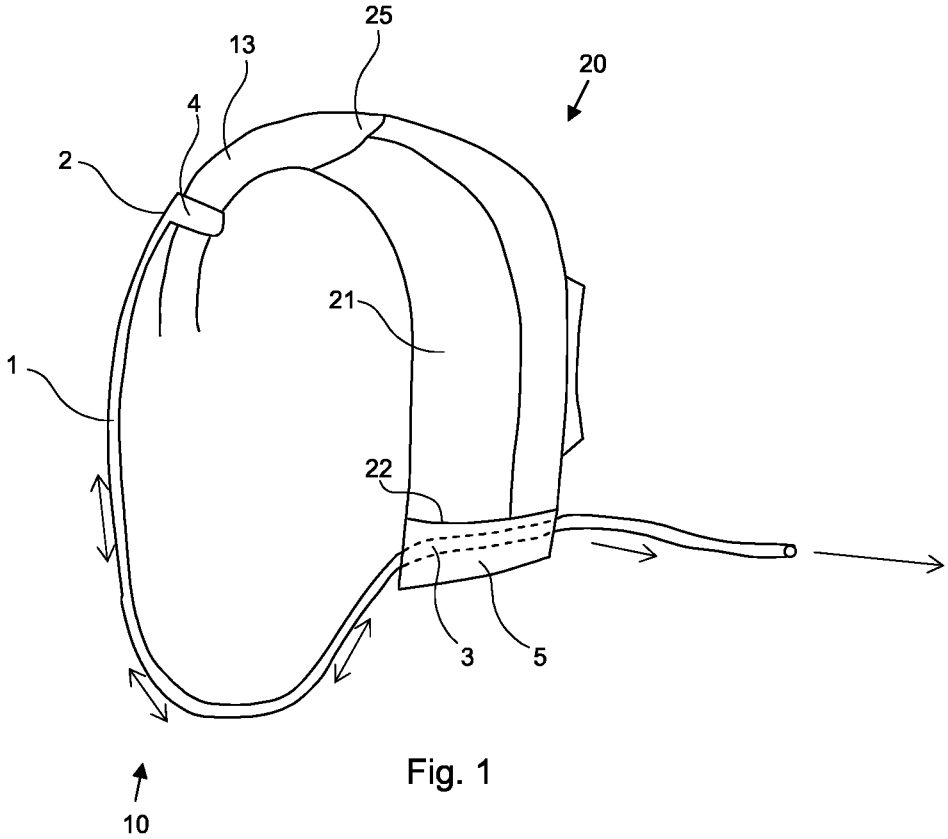
FIG. 1 schematically depicts a side view of a hearing aid retainer accessory connected to a hearing aid according to the invention.

FIG. 1 shows a hearing aid retainer accessory 10 for a hearing aid 20, the hearing aid 20 being designed as a BTE-hearing aid with a relatively large diameter longitudinal end face portion 22 and a relatively smaller diameter hook-end 25 to which a hook 13 is attached.

The hearing aid retainer accessory 10 comprises an elongated string 1, a first attaching means 4 and a second attaching means 5. The elongated string 1 is configured as an elastic tube, with a first end portion 2 and a second portion 3. The first attaching means 4 is configured as a flexible sleeve 4 and attached around the hook 13 and is connected to the first end portion 2 of the elongated string 1. The flexible sleeve has an inner diameter adapted to the outer diameter of the hook 13. Furthermore, the first attaching means 4 has a smaller physical dimension than the second attaching means 5.

The second attaching means 5 comprises a tubular feed-through 7. The tubular feed-through accommodates the second portion 3 of the elongated string 1 in a friction fitting manner. The second attaching means 5 is connected to a longitudinal end face portion 22 belonging to a housing 21 of the hearing aid 20.

A retaining ring is formed of both the geometry of the hearing aid and the elongated string 1, wherein neither one of the first and second attaching means 4, 5 adds to the circumferential geometry of the housing 21. As indicated by the arrows the elongated string 1 can be pulled through the tubular feed-through 7 in order to adjust the hearing aid retainer accessory 10 to a user's ear.

Figure 2:
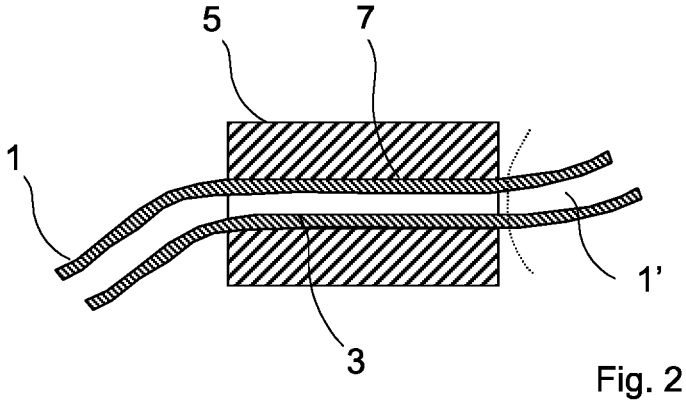
FIG. 2 schematically depicts a side view of a tubular feed-through accommodating a second portion.

A tubular feed-through 7 comprised by a second attaching means 5 in FIG. 2 accommodates a second portion 3 of an elongated string 1. The elongated string 1 is configured as an elastic tube. After the hearing aid retainer accessory 10 has been properly adjusted to a user's ear, an expandable portion 1' of the elongated string 1 (a portion that is not part of the retaining ring formed) can be cut off.

Figure 3:
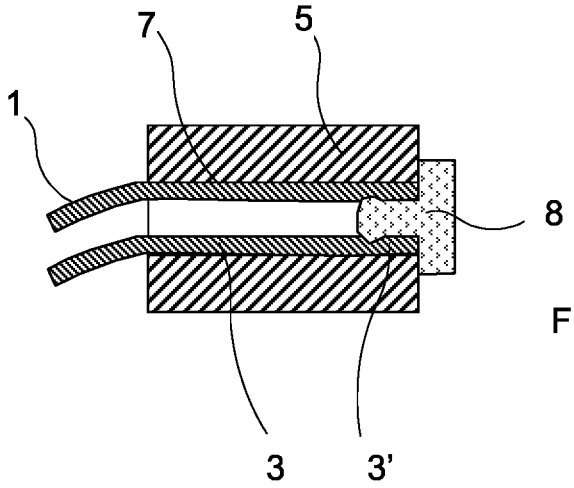
FIG. 3 schematically depicts a schematic side view of the tubular feed-through of FIG. 2 accommodating a second end portion secured by a lock pin.

FIG. 3 shows elongated string 1 without the expandable portion 1'. Hence, the second portion 3 constitutes a second end portion 3'. The second end portion 3' is secured in the tubular feed-through 7 by a lock pin 8, which is engaged axially in second end portion 3'.

Figure 4:
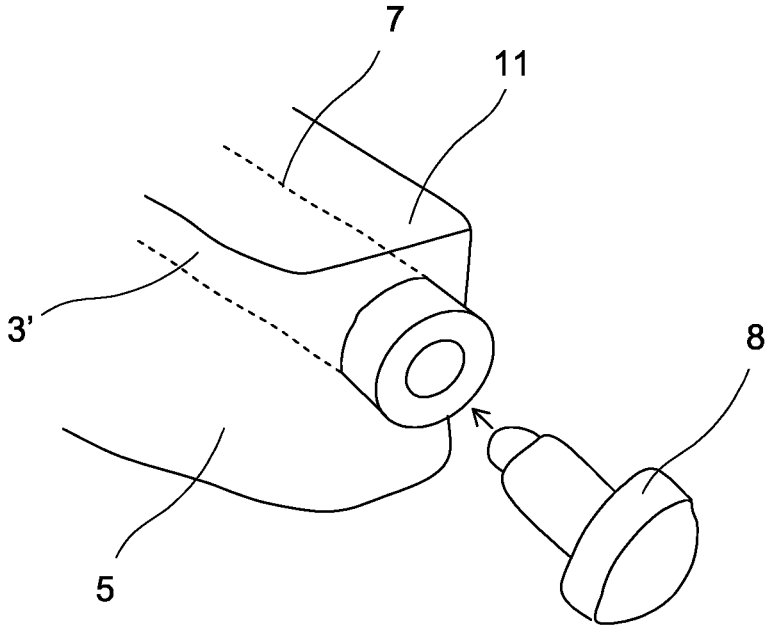
FIG. 4 schematically depicts a perspective view of a lock pin to be engaged to a second end portion.

FIG. 4 shows a perspective view of a lock pin 8 to be engaged to a second end portion 3' securing it to a second attaching means 5. Again the second end portion 3' is accommodated by a tubular feed-through 7.

Figure 5:
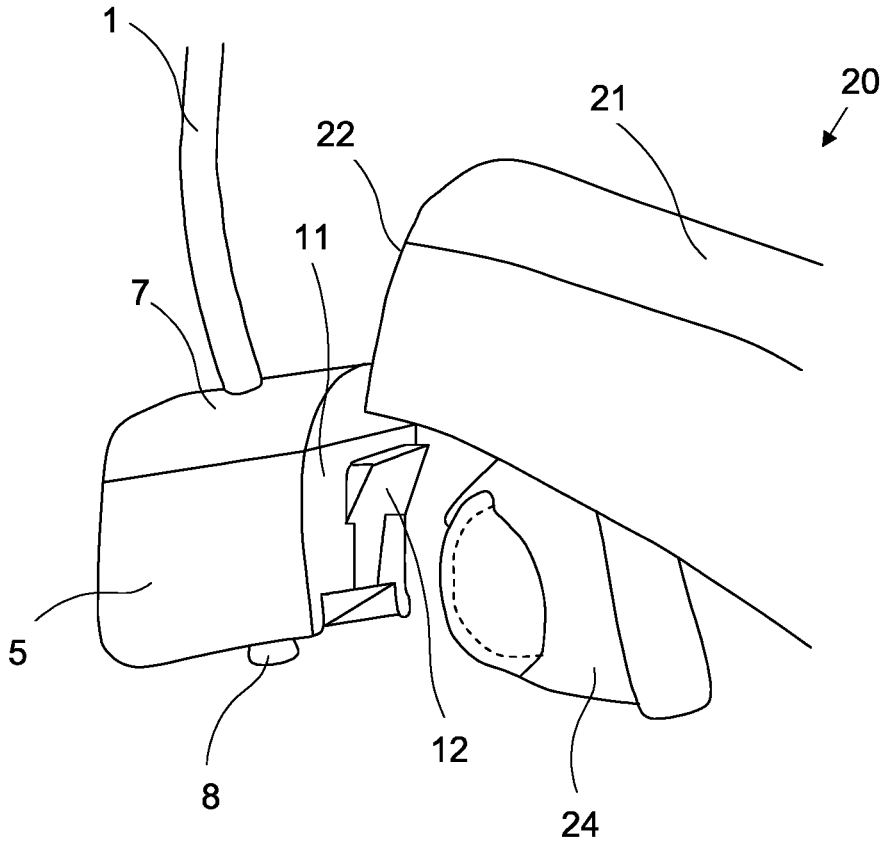
FIG. 5 schematically depicts a perspective view of a base portion having a complementary cut out region.
Figure 6:
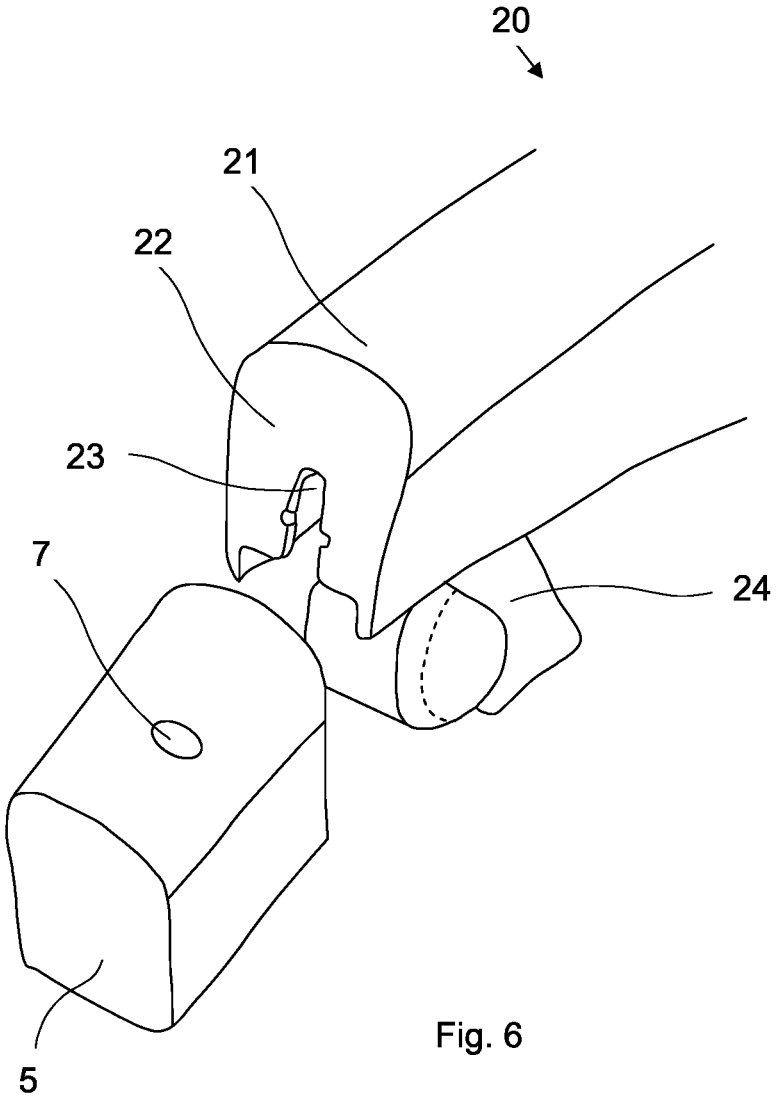
FIG. 6 schematically depicts a perspective view of a second attaching means having a hook-like protrusion.

FIG. 5 depicts a second attaching means 5 connected to an elongated string 1 and secured with lock pin 8 and about to be attached to a longitudinal end face portion 22 of a housing 21 of a hearing aid 20. The second attaching means 5 comprises an end surface portion 11 from which a hook-like protrusion 12 extends. The end surface portion 11 has surface area of roughly the same size as the longitudinal end face portion 22. The hook-like protrusion 12 is configured to engage to a complementary cut out region 23 located in the longitudinal end face portion 22 of the housing 21 of the hearing aid 20 shown in FIG. 6.

Prior to the attachment of the second attaching means 5 to the longitudinal end face portion 22, a battery drawer 24 of the hearing 20 is slid open. Thereafter the second attaching means 5 is guided, whereby the end surface portion 11 is kept parallel to longitudinal end face portion 22, in a sliding manner onto the longitudinal end face portion 22 until the hook-like protrusion 12 engages to the complementary cut out region 23. The battery drawer 24 is closed afterwards.

The invention claimed is:

1. A hearing aid retainer accessory to be used together with a hearing aid having a housing with a relatively large diameter longitudinal end face portion and a relatively smaller diameter hook-end to which a hook is attached, the hearing aid retainer accessory comprising:

an elongated string with a first end portion and a second portion;

a first attaching connector connected to the first end portion; and a second attaching connector connected to the second portion, wherein the elongate string is configured to be pulled through the second attaching connector, the first attaching connector is attachable to the hook of the hearing aid, the second attaching connector is attachable to the longitudinal end face portion of the housing of the hearing aid, such that a retaining ring is formed of both the geometry of the hearing aid and the elongated string, and the second portion of the elongated string, without an expandable portion, is configured to be secured to the second attaching connector by a lock pin.

2. The hearing aid retainer accessory according to claim 1, wherein the second attaching connector comprises a tubular feed-through accommodating the second portion of the elongated string in a friction fitting and adjustable manner.

3. The hearing aid retainer accessory according to claim 2, wherein the second portion of the elongated string constitutes a tubular second end portion of the elongated string, wherein the second end portion is secured in the tubular feed-through by the lock pin.

4. The hearing aid retainer accessory according to claim 1, wherein the first attaching connector is configured as a flexible sleeve having a smaller physical dimension than the second attaching connector.

5. The hearing aid retainer accessory according to claim 1, wherein the first attaching connector is configured as a flexible sleeve having an inner diameter adapted to an outer diameter of the hook.

6. The hearing aid retainer accessory according to claim 1, wherein the second attaching connector comprises a hook-like protrusion mechanically engageable to a complementary cut out region in the longitudinal end face portion of the housing of the hearing aid.

7. The hearing aid retainer accessory according to claim 1, wherein the second attaching connector comprises an end surface portion from which a hook-like protrusion extends, and the end surface portion has surface area of roughly the same size as the longitudinal end face portion of the housing of the hearing aid.

8. A hearing aid and a hearing aid retainer accessory attached thereto, the hearing aid having a housing with a relatively large diameter longitudinal end face portion and a relatively smaller diameter hook-end to which a hook is attached, the hearing aid retainer accessory comprising:

an elongated string with a first end portion and a second portion;

a first attaching connector connected to the first end portion; and a second attaching connector connected to the second portion, wherein the elongate string is pulled through the second attaching connector, the first attaching connector is attached to the hook of the hearing aid, the second attaching connector is attached to the longitudinal end face portion of the housing of the hearing aid, such that a retaining ring is formed of both the geometry of the hearing aid and the elongated string, and the second portion of the elongated string, without an expandable portion, is secured to the second attaching connector by a lock pin.

9. The hearing aid and hearing aid retainer accessory according to claim 8, wherein the second attaching connector comprises a tubular feed-through accommodating the second portion of the elongated string in a friction fitting and adjustable manner.

10. The hearing aid and hearing aid retainer accessory according to claim 9, wherein the second portion constitutes a tubular second end portion of the elongated string, wherein the second end portion is secured in the tubular feed-through by the lock pin.

11. The hearing aid and hearing aid retainer accessory according to claim 8, wherein the first attaching connector is configured as a flexible sleeve having a smaller physical dimension than the second attaching connector.

12. The hearing aid and hearing aid retainer accessory according to claim 8, wherein the first attaching connector is configured as a flexible sleeve having an inner diameter adapted to an outer diameter of the hook.

13. The hearing aid and hearing aid retainer accessory according to claim 8, wherein the second attaching connector comprises a hook-like protrusion mechanically engaged to a complementary cut out region in the longitudinal end face portion of the housing of the hearing aid.

14. The hearing aid and hearing aid retainer accessory according to claim 8, wherein the second attaching connector comprises an end surface portion from which a hook-like protrusion extends, wherein the end surface portion has surface area of roughly the same size as the longitudinal end face portion of the housing of the hearing aid.

* * * * *